US011690492B2

(12) United States Patent
Rukavina et al.

(10) Patent No.: US 11,690,492 B2
(45) Date of Patent: Jul. 4, 2023

(54) FLOOR CLEANER

(71) Applicant: Techtronic Floor Care Technology Limited, Tortola (VG)

(72) Inventors: Douglas M. Rukavina, Concord, NC (US); Donovan Bode, Charlotte, NC (US); Juan Aviles Quintero, Huntersville, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 168 days.

(21) Appl. No.: 17/238,992

(22) Filed: Apr. 23, 2021

(65) Prior Publication Data

US 2021/0235957 A1 Aug. 5, 2021
US 2022/0346618 A9 Nov. 3, 2022

Related U.S. Application Data

(63) Continuation of application No. 16/712,024, filed on Dec. 12, 2019, now Pat. No. 10,986,975.
(Continued)

(51) Int. Cl.
*A47L 11/40* (2006.01)
*A47L 11/30* (2006.01)

(52) U.S. Cl.
CPC ..... *A47L 11/4008* (2013.01); *A47L 11/30* (2013.01); *A47L 11/4075* (2013.01);
(Continued)

(58) Field of Classification Search
CPC .. A47L 11/4008; A47L 11/30; A47L 11/4075; A47L 11/4077; A47L 11/4083;
(Continued)

(56) References Cited

U.S. PATENT DOCUMENTS 2,394,271 A 2/1946 Taylor
3,866,868 A 2/1975 Fish et al.
(Continued)

FOREIGN PATENT DOCUMENTS

CN 101143080 A 3/2008
CN 201058001 Y 5/2008
(Continued)

OTHER PUBLICATIONS

Examination Report No. 1 issued by the Australian Government for Application No. 2019401424 dated Jun. 2, 2022 (2 pages).
(Continued)

*Primary Examiner* — David G Cormier
*Assistant Examiner* — Thomas Bucci
(74) *Attorney, Agent, or Firm* — Michael Best & Friedrich LLP

(57) ABSTRACT

A floor cleaner includes an electrically powered component and a switch. The switch includes a button including an actuator surface. A fluid channel is formed by a fluid collection surface disposed below the button and an outer channel wall extending upwardly from the fluid collection surface, the fluid channel having a fluid outlet. A projection of the button is received in an inner button aperture formed by an inner wall extending from the fluid collection surface forming a bushing around the projection. The inner wall inhibits flow of fluid from the fluid channel through the inner button aperture. The outer channel wall surrounds the aperture wall such that fluid entering the body between the perimeter of the button actuator surface and the aperture wall is collected by the fluid channel and directed to the fluid outlet.

20 Claims, 6 Drawing Sheets

Related U.S. Application Data

(60) Provisional application No. 62/784,075, filed on Dec. 21, 2018.

(52) U.S. Cl.
CPC ..... *A47L 11/4077* (2013.01); *A47L 11/4083* (2013.01); *A47L 11/4094* (2013.01)

(58) Field of Classification Search
CPC ... A47L 11/4094; A47L 9/2857; A47L 9/2847
USPC ..... 134/58 R
See application file for complete search history.

(56) References Cited

U.S. PATENT DOCUMENTS

| | | | | |
|---|---|---|---|---|
| 4,814,566 | A | 3/1989 | Sigi | |
| 4,910,828 | A * | 3/1990 | Blase | A47L 11/34 15/352 |
| 5,301,386 | A * | 4/1994 | Thomas | A47L 11/34 15/353 |
| 5,613,271 | A * | 3/1997 | Thomas | A47L 11/34 15/322 |
| 5,735,017 | A * | 4/1998 | Barnes | A47L 11/4027 15/328 |
| 5,788,059 | A | 8/1998 | Jahangiri | |
| 5,799,362 | A * | 9/1998 | Huffman | A47L 11/4083 15/328 |
| 5,806,767 | A * | 9/1998 | Polti | A47L 9/2836 239/525 |
| 5,920,955 | A * | 7/1999 | Berfield | A47L 7/0038 15/352 |
| 5,990,431 | A | 11/1999 | Wright | |
| 6,082,376 | A | 7/2000 | Karr et al. | |
| 6,107,583 | A | 8/2000 | Berfield | |
| 6,243,913 | B1 * | 6/2001 | Frank | A47L 11/4083 15/320 |
| 6,248,007 | B1 | 6/2001 | deBlois et al. | |
| 7,073,226 | B1 * | 7/2006 | Lenkiewicz | A47L 11/4083 15/327.2 |
| 7,228,589 | B2 * | 6/2007 | Miner | A47L 11/34 15/385 |
| 7,234,197 | B2 * | 6/2007 | Tran | A47L 11/4038 15/346 |
| 8,549,697 | B1 * | 10/2013 | Moyher, Jr. | A47L 11/4044 15/319 |
| 9,211,044 | B2 * | 12/2015 | Conrad | A47L 9/1608 |
| 9,474,424 | B2 * | 10/2016 | Moyher, Jr. | A47L 11/4025 |
| 9,532,693 | B1 * | 1/2017 | Tran | A47L 11/4008 |
| 9,615,703 | B2 * | 4/2017 | Moyher, Jr. | A47L 11/4083 |
| 9,757,004 | B2 | 9/2017 | Neumann et al. | |
| 10,327,616 | B2 * | 6/2019 | Moyher, Jr. | A47L 9/0045 |
| 2003/0233727 | A1 * | 12/2003 | Wheeler | A47L 11/4086 15/320 |
| 2004/0064907 | A1 | 4/2004 | Blaustein et al. | |
| 2005/0150066 | A1 | 7/2005 | Lin | |
| 2006/0123587 | A1 * | 6/2006 | Parr | A47L 11/34 15/320 |
| 2006/0156509 | A1 * | 7/2006 | Luebbering | A47L 9/0009 15/410 |
| 2006/0272120 | A1 * | 12/2006 | Barrick | G01F 23/58 15/344 |
| 2007/0016328 | A1 * | 1/2007 | Ziegler | A47L 9/009 701/23 |
| 2007/0266519 | A1 * | 11/2007 | Kostreba | A47L 7/0009 15/321 |
| 2009/0229075 | A1 * | 9/2009 | Eriksson | A46B 13/006 15/48 |
| 2011/0079248 | A1 * | 4/2011 | Huffman | A47L 11/4011 134/21 |
| 2012/0304416 | A1 * | 12/2012 | Nguyen | A47L 11/302 705/500 |
| 2013/0318741 | A1 * | 12/2013 | Moyher, Jr. | A47L 11/4025 15/327.1 |
| 2014/0201940 | A1 * | 7/2014 | Moyher, Jr. | A47L 11/4083 15/321 |
| 2015/0188102 | A1 * | 7/2015 | Gee, II | A47L 9/2884 429/96 |
| 2015/0245757 | A1 * | 9/2015 | Wall | A47L 11/202 15/321 |
| 2016/0367100 | A1 * | 12/2016 | Tran | A47L 11/4011 |
| 2017/0119225 | A1 * | 5/2017 | Xia | A47L 11/4044 |
| 2017/0164801 | A1 * | 6/2017 | Moyher, Jr. | A47L 9/0027 |
| 2019/0082905 | A1 * | 3/2019 | Chavana, Jr. | A47L 5/365 |
| 2019/0274509 | A1 * | 9/2019 | Moyher, Jr. | A47L 11/4016 |
| 2020/0205624 | A1 * | 7/2020 | Rukavina | A47L 7/0023 |

FOREIGN PATENT DOCUMENTS

| | | | |
|---|---|---|---|
| CN | 202739910 | U | 2/2013 |
| CN | 203415454 | U | 1/2014 |
| CN | 205319068 | U | 6/2016 |
| CN | 205881749 | U | 1/2017 |
| CN | 107275139 | A | 10/2017 |
| CN | 107303162 | A | 10/2017 |
| CN | 207604912 | U | 7/2018 |
| EP | 1138244 | A1 | 10/2001 |
| EP | 3263236 | A1 | 1/2018 |

OTHER PUBLICATIONS

Chinese Patent Office Action for Application No. 201980084924.5 dated Feb. 9, 2022 (15 pages including statement of relevance).
International Search Report and Written Opinion for Application No. PCT/US2019/065925 dated May 15, 2020 (13 pages).
Chinese Patent Office Action for Application No. 201980084924.5 dated Oct. 25, 2022 (13 pages including statement of relevance).

* cited by examiner

FLOOR CLEANER

CROSS-REFERENCE TO RELATED APPLICATIONS

This application is a continuation of U.S. patent application Ser. No. 16/712,024, filed on Dec. 12, 2019, which issued as U.S. Pat. No. 10,986,975 on Apr. 27, 2021, which claims priority to U.S. Provisional Patent Application No. 62/784,075, filed Dec. 21, 2018, the entire contents of all which are hereby incorporated by reference herein.

BACKGROUND

The present invention relates to floor cleaners. Floor cleaners may include a supply tank having fluid and a power switch that controls the supply of electrical power to an electrically powered component of the floor cleaner. When fluid is provided, there is the possibility that fluid accidentally contacts the power switch. For example, if the fluid is on the user's hand, the fluid may drip onto the power switch when the user operates the power switch.

SUMMARY

In one embodiment, a floor cleaner includes a supply tank configured to store a fluid, a distribution nozzle in fluid communication with the supply tank and the distribution nozzle is configured to spray the fluid onto a surface to be cleaned. The floor cleaner further includes an electrically powered component and a power switch operable to control a supply of electrical power to the electrically powered component. The power switch includes a button including an actuator surface pressed by a user to operate the power switch and a wall that extends away from the actuator surface. The power switch further includes a frame, the button movable relative to the frame to operate the power switch to control the supply of electrical power. The frame includes an inner wall that defines a button aperture, the button extending into the button aperture, an outer wall, a fluid outlet, and a fluid collection surface between the inner wall and the outer wall that directs fluid on the fluid collection surface toward the fluid outlet. The wall of the button is received in a gap between the inner wall and the outer wall of the frame so that fluid is directed along the wall of the button to the fluid collection surface and inhibited from passing through the button aperture.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
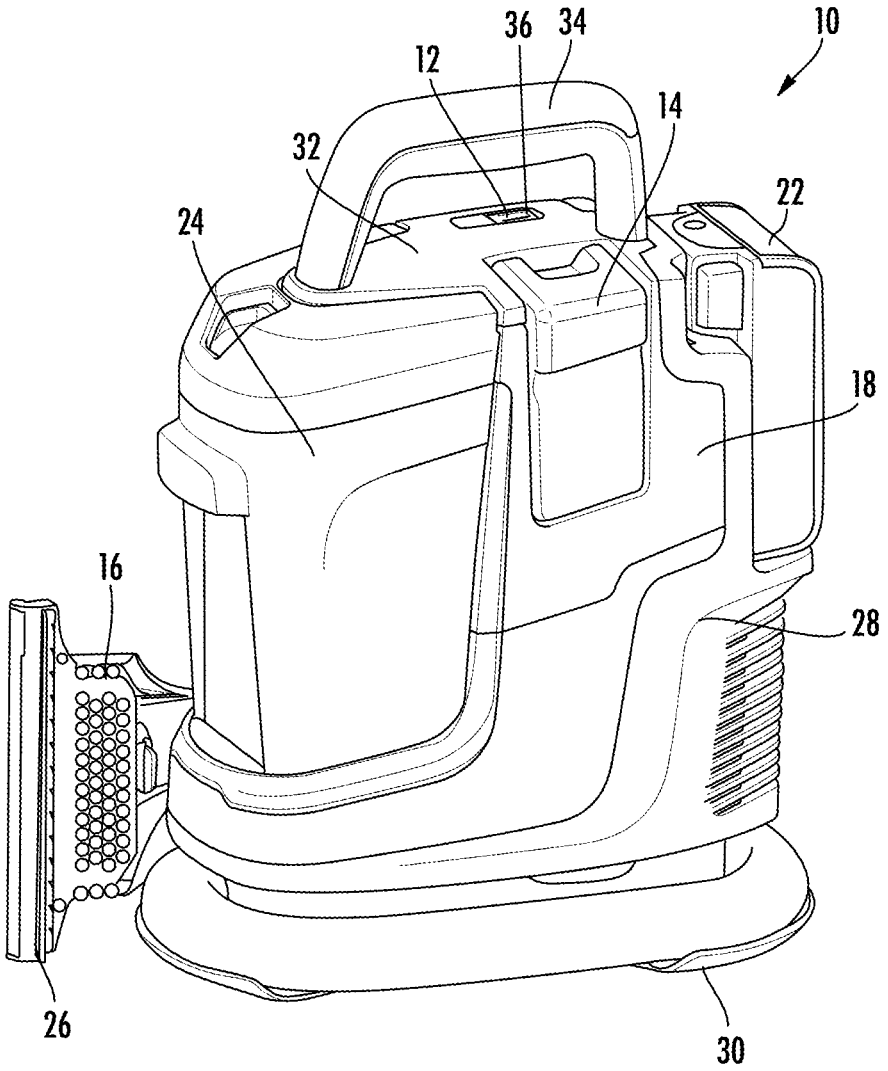
FIG. 1 is a perspective view of a floor cleaner according to one embodiment.

FIG. 1 illustrates a floor cleaner 10 according to one embodiment. The floor cleaner 10 includes a power switch 12. As will be discussed in more detail below, the power switch 12 is configured to inhibit liquid that spills or drips on the switch 12 from contacting electrical components inside the floor cleaner 10.

With continued reference to FIG. 1, the floor cleaner 10 includes a supply tank 14, a distribution nozzle 16, and an electrically powered component 18. The supply tank 14 stores a cleaning fluid that may include water, a detergent, or a mixture of water and detergent. In one embodiment, the supply tank 14 is removably coupled to the floor cleaner 10 and the user refills the supply tank 14. The supply tank 14 is in fluid communication with the distribution nozzle 16. An actuator 20 (FIG. 2) is operable by the user to control the flow of fluid from the supply tank 14 through the distribution nozzle 16. For example, in one embodiment, the user squeezes the actuator 20, which causes fluid to flow from the supply tank 14 and through the nozzle 16 and onto the surface being cleaned.

Figure 2:
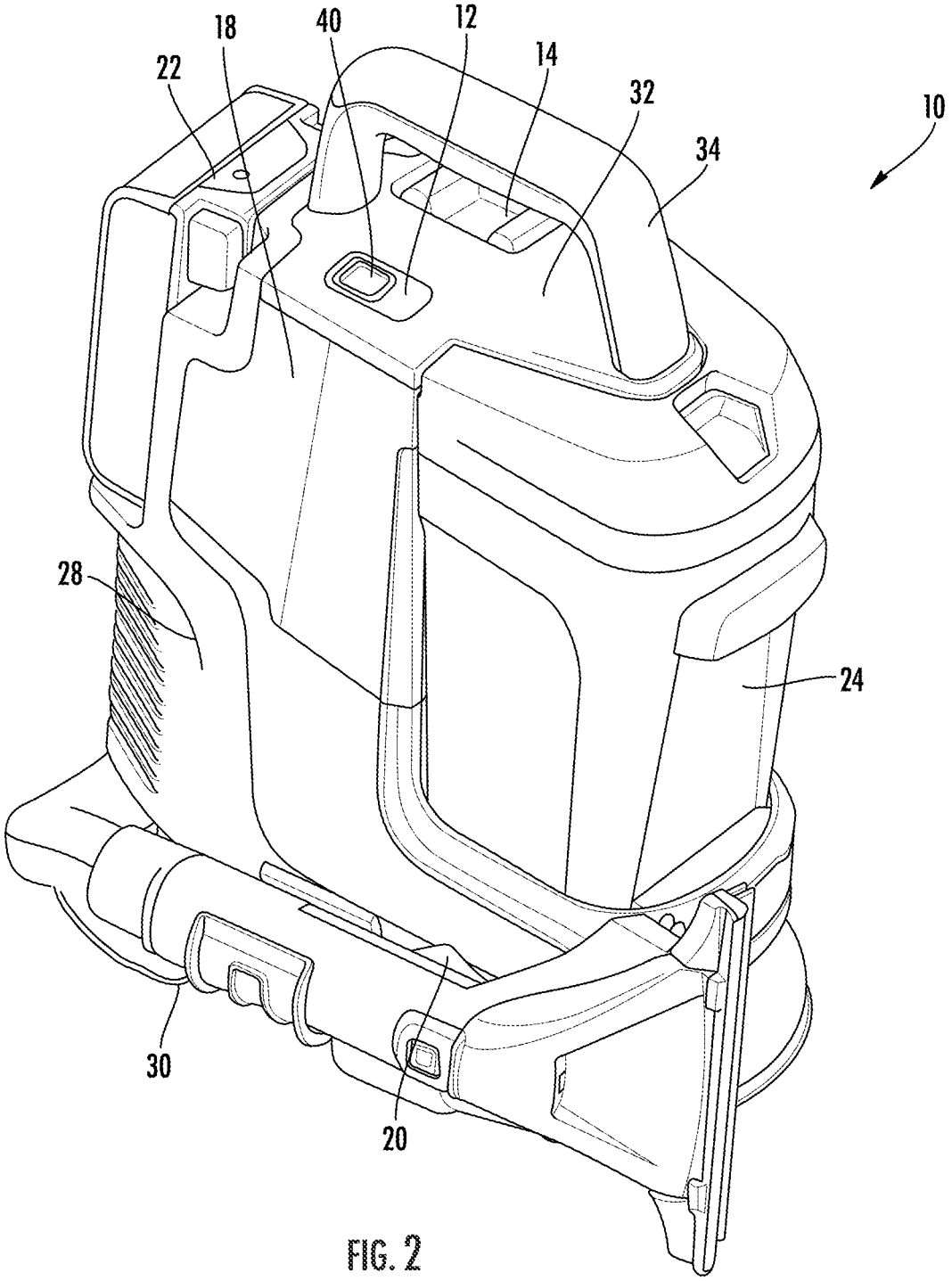
FIG. 2 is an alternative perspective view of the floor cleaner of FIG. 1.

Referring to FIGS. 1 and 2, in the illustrated embodiment, the electrically powered component 18 includes a suction source having a motor and a fan. A battery 22 supplies electrical power to the electrically powered component 18 in the illustrated embodiment. In other embodiments, the floor cleaner 10 includes an electrical cord that plugs into an outlet to supply AC power to the electrical component 18. The illustrated floor cleaner 10 further includes a recovery tank 24 and a suction nozzle 26. The recovery tank 24 is in fluid communication with the suction nozzle 26. In one embodiment, the electrically powered component 18 is operable draw air and the cleaning fluid from the surface being cleaned through the suction nozzle 26 and into the recovery tank 24. Air is separated from the fluid and the fluid is retained in the recovery tank 24 while the air is exhausted from the floor cleaner 10.

In other embodiments, the electrically powered component 18 can include other or additional components. For example, the electrically powered component may include a heating element that heats the fluid in or from the supply tank 14. In yet other embodiments, the electrically powered component may include a supply valve or a control system. Also, in the illustrated embodiment, the floor cleaner 10 includes the recovery tank 24 and the suction source and the floor cleaner 10 is an extractor. In other embodiments, the floor cleaner may not include a recovery tank or a suction source. For example, the floor cleaner may include a mop, a steam cleaner, a heated wet mop, and the like.

The illustrated floor cleaner 10 further includes a body 28. The body 28 includes a base 30 and a top surface 32 opposite the base 30. A handle 34 extends from the top surface 32 of the body 28. The handle 34 is used to carry the floor cleaner 10 or move the floor cleaner 10. The power switch 12 is below and adjacent the handle 34. Therefore, if the user's hand is wet, water may drip from the user's hand onto the power switch 12 when the user grabs the handle 34. In the illustrated embodiment, the suction source is inside the body 28 and the supply tank 14 and the recovery tank 24 are removably coupled to the body 28.

Figure 3:
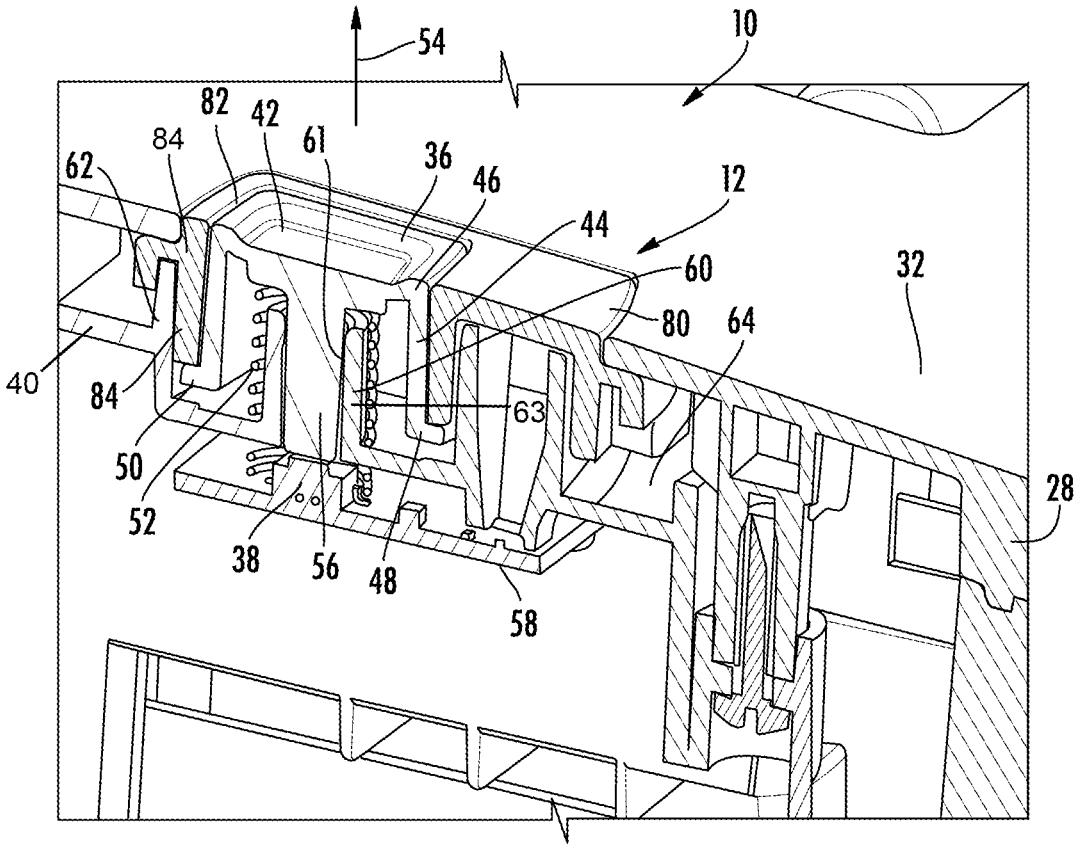
FIG. 3 is a cross-sectional view of a power switch of the floor cleaner of FIG. 1.

Referring to FIG. 3, the power switch 12 is operable to control the supply of electrical power to the electrically powered component 18. In one embodiment, the power switch 12 is used to turn the floor cleaner 10 'on' and 'off'. The illustrated power switch 12 includes a button 36, an electronic switch 38, and a frame 40. The button 36 includes an actuator surface 42 and a wall 44 that extends away from the actuator surface 42. The actuator surface 42 is contacted (e.g., pressed) by the user's finger to operate the power switch 12. The actuator surface 42 forms a portion of the outer surface of the body, specifically the top surface 32, in the illustrated embodiment. The wall 44 extends around the perimeter of the actuator surface 42. The wall 44 includes a first end 46 adjacent the actuator surface 42 and a second end 48 opposite the first end 46. The second end 48 includes a tab 50. A spring 52 biases the button 36 in the direction of arrow 54 in FIG. 3. The tab 50 contacts the frame 40 to limit movement of the button 36 beyond the position shown in FIG. 3 in the direction arrow 54 by the spring 52. The button 36 further includes a projection 56. The projection 56 actuates the electronic switch 38 when the user presses the button 36 to move the button 36 relative to the frame 40 in a direction opposite the arrow 54 of FIG. 3, which controls the supply of electrical power to the electrically powered component 18. In the illustrated embodiment, the projection 56 contacts the electronic switch 38. Alternatively, the projection contacts an actuating member that contacts or otherwise controls the switch. In the illustrated embodiment, the electronic switch 38 is coupled to a circuit board 58. Alternatively, the electronic switch 38 is a stand-alone switch connected to the electrically powered component. The circuit board 58 includes additional electrical components that control operation of the floor cleaner 10.

Figure 7:
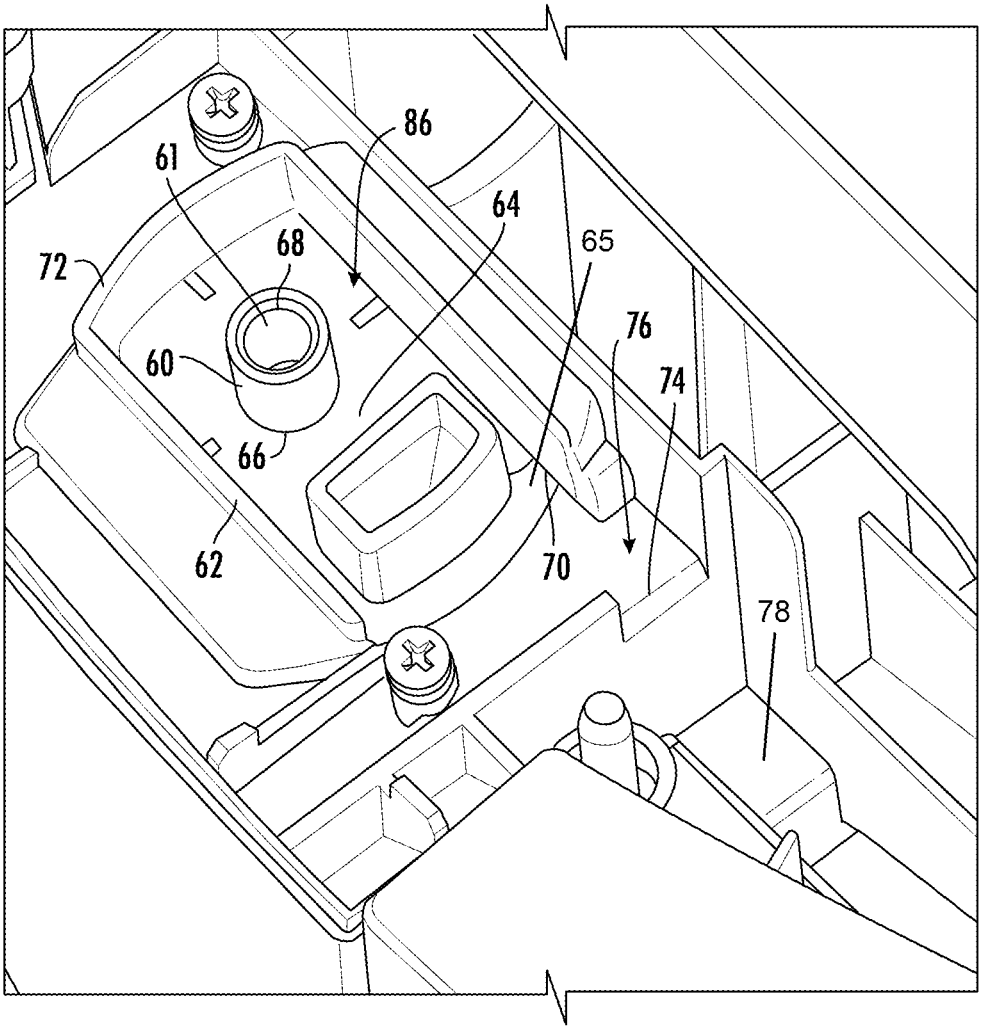
FIG. 7 is the enlarged perspective view of FIG. 6 with a button of the power switch removed.

Referring to FIGS. 3 and 7, the frame 40 includes an inner wall 60. The inner wall 60 defines an inner button aperture 61. The projection 56 of the button 36 extends through the aperture 61 and the aperture 61 is open to the inside of the body 28 of the floor cleaner 10, including the circuit board 58. In one embodiment, the inner wall 60 and inner button aperture 61 form a bushing 63 to guide movement of the button, and the projection 56 of the button 36 extends into the bushing 63. The frame 40 further includes an outer wall 62, which is parallel to the inner wall 60 in the illustrated embodiment. A fluid collection surface 64 below the button 36 extends from the inner wall 60 to the outer wall 62. Stated another way, a fluid channel 65 is formed by the fluid collection surface 64 below the button 36 and the outer wall 62 extending upwardly from the fluid collection surface 64. The inner wall 60 extends upwardly from the fluid collection surface 64 around the perimeter of the inner button aperture 61 inhibiting flow of fluid from the fluid channel 65 through the inner button aperture. The inner wall 60 includes a first end 66 adjacent the surface 64 and a second end 68 opposite the first end 66. The outer wall 62 include a first end 70 adjacent the surface 64 and a second end 72 opposite the first end 70. The frame 40 further includes a fluid outlet 74. In the illustrated embodiment, the fluid outlet 74 is formed by a gap 76 in the outer wall 62. In other embodiments, the fluid outlet 74 may include an aperture that extends through the fluid collection surface 64. The fluid collection surface 64 may be sloped to direct fluid on the surface 64 toward the outlet 74. The floor cleaner 10 further includes a drain 78 (FIG. 7). The drain 78 is in fluid communication with the outlet 74 and the floor or surface being cleaned in one embodiment. In one embodiment, the drain 78 directs fluid from the fluid outlet 74 to outside of the body 28.

Figure 4:
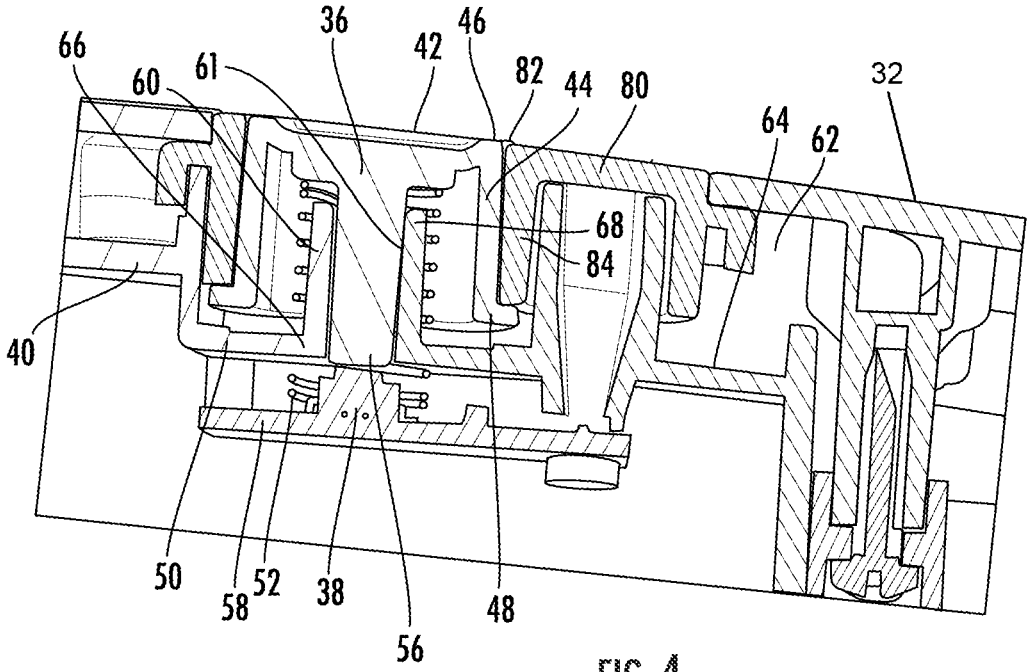
FIG. 4 is an alternative view of the power switch of FIG. 3.
Figure 5:
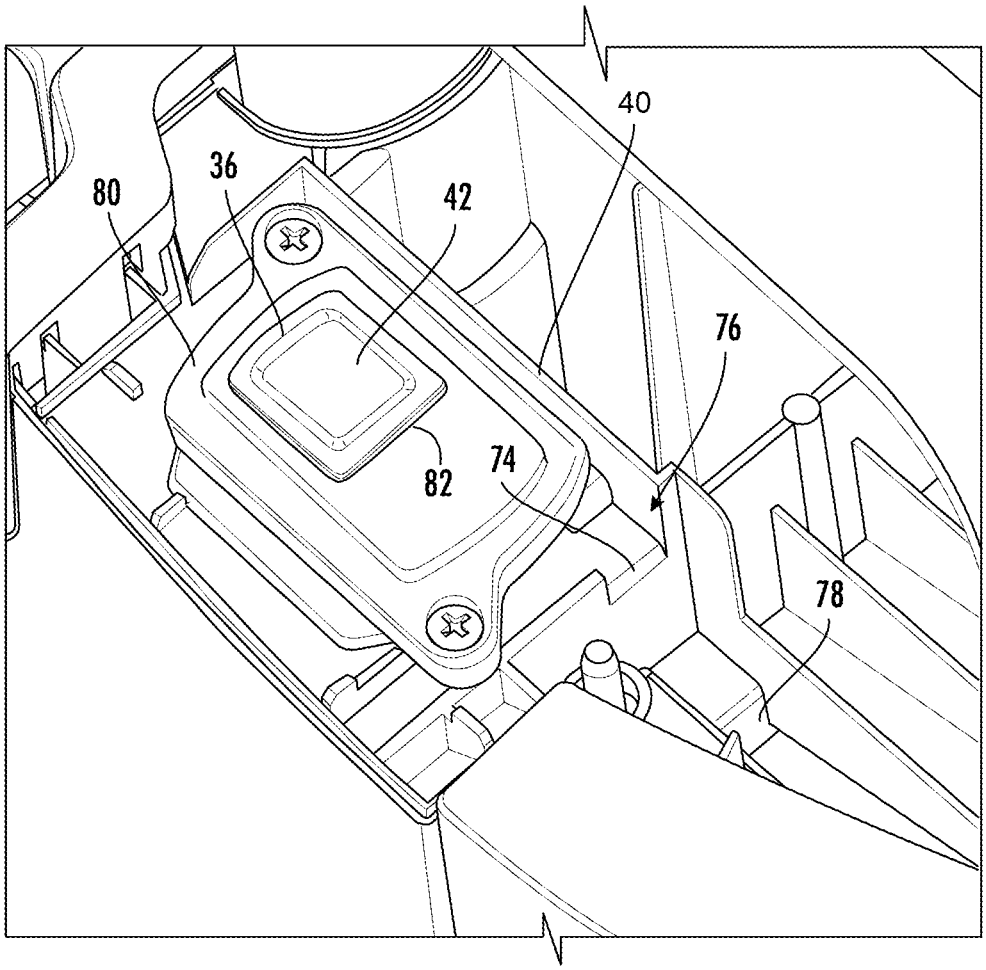
FIG. 5 is an enlarged perspective view of the floor cleaner of FIG. 1 with a cover removed.
Figure 6:
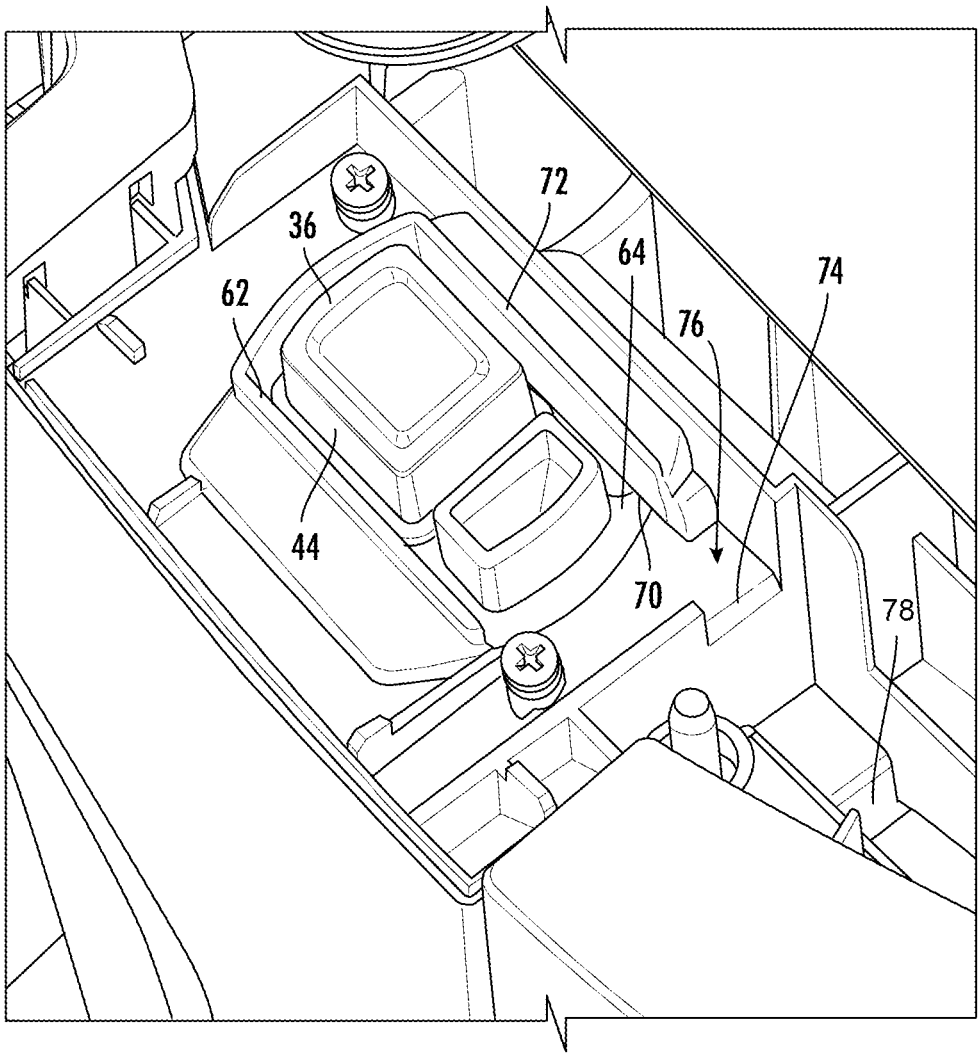
FIG. 6 is an enlarged perspective view of the floor cleaner of FIG. 1 with covers removed.

Referring to FIGS. 4 and 5, the frame 40 further includes a cover 80. The cover 80 includes an outer button aperture 82. The button 36 is located within the button aperture 82. The cover 80 further includes a wall 84 that is between the wall 44 of the button 36 and the outer wall 62 of the frame 40. In some embodiments, a seal maybe located between the wall 44 of the button 36 and the wall 84 of the cover 80.

In operation, the user presses the button 36 to control the supply of electrical power to the electrically powered component 18. In some instances, there may be liquid, such as water or a cleaning fluid from the supply tank, near or on the button 36. For example, fluid may be on the actuator surface 42. The configuration of the power switch 12 inhibits that fluid from traveling to the electronic switch 38 or to the circuit board 58. If fluid would travel down beyond the actuator surface 42, the fluid would travel though a gap 86 between the inner wall 60 and the outer wall 62 and onto the fluid collection surface 64, into the fluid channel. The wall 44 of the button 36 inhibits fluid from passing through the inner button aperture 61 and the fluid travels along the wall 44 and is directed onto the fluid collection surface 64. Fluid on the surface 64 is directed toward the fluid outlet 74 and eventually to the drain 78 where the fluid is then directed to the floor or other suitable location. Accordingly, the power switch 12 includes a drainage system for fluid that inadvertently passes by the button 36.

Although the invention has been described in detail with reference to certain preferred embodiments, variations and modifications exist within the scope and spirit of one or more independent aspects of the invention as described.

What is claimed is:

1. A floor cleaner comprising:

a body including an outer surface;

an electrically powered component disposed within the body;

a switch operable to control operation of the electrically powered component; and a button disposed on the body adjacent the outer surface configured to activate the switch, the button including an actuator surface pressable by a user to operate the switch, and a projection that extends away from the actuator surface into the body configured to actuate the switch when the user presses the button;

the outer surface including a button aperture formed by an aperture wall around a perimeter of the button actuator surface, the button movable relative to the aperture wall when the user presses the button;

a fluid channel formed by a fluid collection surface disposed below the button and an outer channel wall extending upwardly from the fluid collection surface, the fluid channel having a fluid outlet;

the projection of the button is received in an inner button aperture formed by an inner wall extending from the fluid collection surface forming a bushing around the projection, the inner wall inhibiting flow of fluid from the fluid channel through the inner button aperture; and wherein the outer channel wall surrounds the aperture wall such that fluid entering the body between the perimeter of the button actuator surface and the aperture wall is collected by the fluid channel and directed to the fluid outlet.

2. The floor cleaner of claim 1, further comprising a supply tank configured to store a fluid; and a distribution nozzle in fluid communication with the supply tank, the distribution nozzle configured to spray the fluid onto a surface to be cleaned.

3. The floor cleaner of claim 2, wherein the floor cleaner further comprises a suction nozzle, a recovery tank in fluid communication with the suction nozzle, and a suction source in fluid communication with the recovery tank, the suction source operable to draw the fluid from the surface, through the suction nozzle, and into the recovery tank.

4. The floor cleaner of claim 3, wherein the electrically powered component includes the suction source.

5. The floor cleaner of claim 1, wherein the electrically powered component includes one or more selected from the group consisting of a suction source, a heating element, a pump, a supply valve, and a control system.

6. The floor cleaner of claim 1, wherein the switch includes an electronic switch, wherein the button actuates the electronic switch when the actuator surface is pressed by the user to control the supply of power to the electrically powered component.

7. The floor cleaner of claim 6, further comprising a circuit board, wherein the electronic switch is coupled to the circuit board.

8. The floor cleaner of claim 1, wherein the fluid collection surface is sloped toward the fluid outlet when the body is on a horizontal surface.

9. The floor cleaner of claim 1, further comprising a handle, the handle configured to be grabbed by a user to move the floor cleaner, wherein the switch is adjacent the handle.

10. The floor cleaner of claim 1, further comprising a drain in fluid communication with the fluid outlet, wherein the drain directs fluid from the fluid outlet toward a surface to be cleaned.

11. A floor cleaner comprising:

a body including an outer surface;

a supply tank configured to store a fluid;

a distribution nozzle in fluid communication with the supply tank, the distribution nozzle configured to spray the fluid onto a surface to be cleaned;

an electrically powered component; and a switch operable to control operation of the electrically powered component, the switch including a button disposed on the body adjacent the outer surface;

the button including an actuator surface pressed by a user to operate the switch, and a wall that extends away from the actuator surface, the outer surface of the body including a button aperture around a perimeter of the wall of the button, the button movable relative to the button aperture to operate the switch when the user presses the button;

a fluid channel formed by a fluid collection surface disposed below the button and an outer wall extending upwardly from the fluid collection surface around the button, the fluid channel having a fluid outlet; and an inner wall extending from the fluid collection surface defining an inner button aperture, the button extending into the inner button aperture, wherein the wall of the button is received in a gap between the inner wall and the outer wall such that fluid entering the button aperture is directed along the wall of the button to the fluid collection surface and inhibited from passing through the inner button aperture.

12. The floor cleaner of claim 11, wherein the floor cleaner further comprises a suction nozzle, a recovery tank in fluid communication with the suction nozzle, and a suction source in fluid communication with the recovery tank, the suction source operable to draw the fluid from the surface, through the suction nozzle, and into the recovery tank.

13. The floor cleaner of claim 12, wherein the electrically powered component includes the suction source.

14. The floor cleaner of claim 11, wherein the electrically powered component includes one or more selected from the group consisting of a suction source, a heating element, a pump, a supply valve, and a control system.

15. The floor cleaner of claim 11, wherein the switch includes an electronic switch, wherein the button actuates the electronic switch when the actuator surface is pressed by the user to control the supply of power to the electrically powered component.

16. The floor cleaner of claim 15, further comprising a circuit board, wherein the electronic switch is coupled to the circuit board.

17. The floor cleaner of claim 11, wherein the button includes a projection that extends into the inner button aperture to contact the switch to operate the switch.

18. The floor cleaner of claim 11, wherein the fluid collection surface is sloped toward the fluid outlet when the body is on a horizontal surface.

19. The floor cleaner of claim 11, further comprising a drain in fluid communication with the fluid outlet, wherein the drain directs fluid from the fluid outlet toward a surface to be cleaned.

20. The floor cleaner of claim 11, further comprising a handle, the handle configured to be grabbed by a user to move the floor cleaner, wherein the switch is adjacent the handle.

* * * * *